US005936194A

United States Patent [19]

Marlow et al.

[11] Patent Number: 5,936,194

[45] Date of Patent: Aug. 10, 1999

[54] THICKENED EMULSION COMPOSITIONS FOR USE AS PROPELLANTS AND EXPLOSIVES

[75] Inventors: Jill M. Marlow, Macedonia; James H. Bush, Mentor, both of Ohio

[73] Assignee: The Lubrizol Corporation, Wickliffe, Ohio

[21] Appl. No.: 09/025,196

[22] Filed: Feb. 18, 1998

[51] Int. Cl.[6] ..... C06B 45/10

[52] U.S. Cl. ..... 149/2; 149/19.91; 149/109.2; 102/289

[58] Field of Search ..... 149/2, 21, 109.2, 149/19.91; 102/289

[56] References Cited

U.S. PATENT DOCUMENTS

| | | | |
|---|---|---|---|
| 3,255,108 | 6/1966 | Wiese | 252/32.7 |
| 3,269,946 | 8/1966 | Weise | 252/32.5 |
| 4,216,114 | 8/1980 | Baker | 252/341 |
| 4,357,184 | 11/1982 | Binet et al. | 149/2 |
| 4,445,576 | 5/1984 | Drake et al. | 166/291 |
| 4,473,418 | 9/1984 | Bampfield et al. | 149/2 |
| 4,502,161 | 3/1985 | Sujansky et al. | 149/21 |
| 4,676,849 | 6/1987 | Curtin et al. | 149/2 |
| 4,708,753 | 11/1987 | Forsberg | 149/2 |
| 4,722,757 | 2/1988 | Cooper et al. | 149/2 |
| 4,764,230 | 8/1988 | Bates et al. | 149/2 |
| 4,818,309 | 4/1989 | Yabsley et al. | 149/2 |
| 4,822,433 | 4/1989 | Cooper et al. | 149/21 |
| 4,828,633 | 5/1989 | Forsberg | 149/2 |
| 4,844,756 | 7/1989 | Forsberg | 149/2 |
| 4,919,178 | 4/1990 | Riga et al. | 149/2 |
| 4,919,179 | 4/1990 | Chattopadhyay | 149/2 |
| 4,940,497 | 7/1990 | Van Ommeren | 149/2 |
| 4,997,494 | 3/1991 | Nguyen | 149/2 |
| 5,026,422 | 6/1991 | Osborne | 106/14.11 |
| 5,047,175 | 9/1991 | Forsberg | 252/356 |
| 5,211,777 | 5/1993 | Nahlovsky et al. | 149/109.6 |
| 5,336,343 | 8/1994 | Hamilton et al. | 149/19.9 |
| 5,366,572 | 11/1994 | Hamilton et al. | 149/19.9 |
| 5,401,341 | 3/1995 | Forsberg et al. | 149/46 |
| 5,512,079 | 4/1996 | Jahnke et al. | 71/64.08 |
| 5,518,517 | 5/1996 | Jahnke et al. | 71/64.08 |

FOREIGN PATENT DOCUMENTS

| | | |
|---|---|---|
| 2007348 | 7/1991 | Canada . |
| 102827A2 | 3/1984 | European Pat. Off. . |
| 561600A2 | 9/1993 | European Pat. Off. . |

*Primary Examiner*—Peter A. Nelson
*Attorney, Agent, or Firm*—David M. Shold

[57] ABSTRACT

Thickened emulsion compositions comprising a discontinuous oxidizer phase, continuous fuel phase, an emulsifier and a thickener composition comprising a carboxyl-containing polymer and a promoter selected from the group consisting of sodium thiocyanate and thiourea are disclosed.

17 Claims, No Drawings

THICKENED EMULSION COMPOSITIONS FOR USE AS PROPELLANTS AND EXPLOSIVES

TECHNICAL FIELD OF THE INVENTION

This invention relates to water-in-oil emulsions and more particularly to energetic water-in-oil emulsions comprising a continuous oil phase, a discontinuous oxidizer phase containing an oxidizing salt, emulsifiers, and a thickener comprising a polymeric material, and a sodium thiocyanate or thiourea or combinations thereof.

BACKGROUND OF THE INVENTION

It is an object of the invention to provide energetic emulsion compositions which thicken to a semi-solid consistency. High energy emulsions are useful as rocket propellants and as emulsion explosives. Water-in-oil emulsions have been used for a variety of uses including emulsion explosives. Water-in-oil explosive emulsions typically comprise a continuous organic phase and a discontinuous oxidizer phase containing water and an oxygen-supplying source such as ammonium nitrate, the oxidizer phase being dispersed throughout the continuous organic phase. Examples of such water-in-oil explosive emulsions are disclosed, inter alia, in U.S. Pat. Nos. 5,047,175; and 4,828,633. The emulsifier is a salt derived from high molecular weight carboxylic acylating agent coupled to a low molecular weight carboxylic acylating agent. Succinic acids and anhydrides are the preferred acylating agents. U.S. Pat. Nos. 5,512,079 and 5,518,517 disclose emulsion fertilizers. The emulsifiers prepared from succinic acylating agents disclosed in these four patents are useful in the present invention.

U.S. Pat. No. 5,366,572 discloses oxazolines useful as bonding agents in solid rocket propellants are disclosed. The oxazoline bonding agents are capable of polymerizing in the presence of ammonium perchlorate. The bonding agents of the present invention are added to the propellant in a range from about 0.1% to about 3% concentration. Importantly, there is no increase in ammonia liberated above baseline propellant values and no increase in end of mix viscosities by using the oxazolines according to the present invention which provides substantial processing savings.

U.S. Pat. No. 5,336,343 discloses vinyl ethers for use as bonding agents in solid rocket propellants are disclosed. The vinyl ether bonding agents are capable of polymerizing in the presence of and around the surface of ammonium perchlorate particles. The bonding agents of the present invention are added to the propellant in a range from about 0.1% to about 3% by weight concentration. Importantly, there is no increase in ammonia liberated above baseline propellant values and no increase in end of mix viscosities by using the vinyl ethers according to the present invention which provides substantial processing savings.

U.S. Pat. No. 5,211,777 discloses waste solid energetic compositions such as waste solid rocket propellant are desensitized for purposes of disposal and burning by being combined with a diluent and a filler which lower the sensitivity, energy output and flame temperature of the compositions and improve their ability to burn in a controlled manner by increasing the burn time. The diluent is an oil with a viscosity of at least about 600 centipoise, and the filler is any of a variety of solid organic material, preferably agricultural waste or wood flour.

U.S. Pat. No. 5,026,422 discloses melt-in-fuel emulsion compositions which are blended with solid particulate oxygen-releasing salts. The explosive composition may additionally comprise a discontinuous gaseous component.

U.S. Pat. No. 4,919,178 discloses water in oil emulsion explosives in which the emulsifier is the reaction product of two components. The first component is the reaction product of certain carboxylic acids or anhydrides, including substituted succinic acids and anhydrides with ammonia or an amine and an alkali metal or an alkaline earth metal. The second component is the salt of a phosphorous containing acid.

European Patent application EP 561,600 A discloses a water-in-oil emulsion explosive in which the emulsifier is the reaction product of a substituted succinic acylating agent, having at least 1.3 succinic groups per equivalent weight of substituents, with ammonia and/or an amine. The substituent is a polyalkene having an number average molecular weight of greater than 500 and preferably 1300–1500.

Canadian Patent 2,007,348 and U.S. Pat. No. 4,940,497 disclose a water-in-oil emulsion explosive composition containing an expanded perlite as a void former. The invention is operative with explosive emulsions formed using a wide variety of emulsifiers including derivatives of polyisobutenyl succinic anhydride.

U.S. Pat. Nos. 4,919,178 and 4,919,179 disclose a water-in-oil emulsion explosive wherein the emulsifier is a particular type of ester of polyisobutenyl succinic anhydride.

U.S. Pat. No. 4,844,756 discloses a water-in-oil emulsion explosive wherein the emulsifier is a salt produced by reacting a hydrocarbyl substituted carboxylic acid or anhydride, including substituted succinic acids and anhydrides, with ammonia, an amine, and/or an alkali or alkaline earth metal.

U.S. Pat. No. 4,818,309 discloses a water-in-oil emulsion explosive wherein the emulsifier is a polyalkenyl succinic acid or derivative thereof. The succinic acid may be used in the form of an anhydride, an ester, an amide or an imide. A condensate with ethanolamine is preferred.

U.S. Pat. No. 4,708,753 discloses a water-in-oil emulsion suitable for use in explosive and functional fluids wherein the emulsifier is a reaction product of a hydrocarbyl substituted carboxylic acid, including a succinic acid, with an amine. The substituent contains 20–500 carbon atoms, and the aqueous phase contains a water soluble, oil insoluble functional additive.

European Patent EP 102,827 A discloses a water-in-oil emulsion composition useful as a well control fluid. The emulsifier is a polyamine derivative, especially an alkylene polyamine derivative, of a polyisobutenyl succinic anhydride or a borated or carboxylated derivative thereof U.S. Pat. No. 4,632,714 discloses energetic compositions, including explosives, which are initially formed at process temperature above the solidification temperature of the contained oxidizer salts as a stable, melt-in-fuel emulsions having a continuous fuel phase and a discontinuous molten oxidizer phase.

U.S. Pat. No. 4,445,576 discloses a water-in-oil emulsion composition useful as a spacer fluid in well drilling. The emulsifier is an amine derivative, especially a polyamine derivative, of a polyalkenyl succinic anhydride.

U.S. Pat. No. 4,216,114 discloses the demulsification of water-in-oil emulsions using a polyester derivative prepared by reacting a 9–18 carbon alkyl or alkenyl substituted succinic anhydride with a polyalkylene glycol, and a polyhydric alcohol containing greater than 3 hydroxyl groups.

U.S. Pat. No. 3,269,946 discloses water-in-oil emulsions useful as lubricants or hydraulic fluids. The emulsifier is a substituted succinimide.

U.S. Pat. No. 3,255,108 discloses water-in-oil emulsions useful as lubricants or hydraulic fluids. The emulsifier is a substituted succinic ester.

SUMMARY OF INVENTION

The present invention provides for energetic emulsion compositions containing a discontinuous oxidizer phase, a continuous oil phase or fuel phase, an emulsifier, and a thickening system consisting of a polymer and a promoter. The energetic emulsion compositions are useful either as rocket propellants or emulsion explosives. When the energetic emulsions of the present invention are used as rocket propellants, they are desensitized so that they undergo a slow combustion reaction which yields a steady, controlled release of gas. When the energetic emulsions of the present invention are used as emulsion explosives, they are formulated so that they undergo a rapid combustion reaction and possible detonation. Optionally, the explosive compositions may also include a gassing agent to generate gas in-situ, or various other sensitizers to enhance the sensitivity of the explosive. The discontinuous oxidizer phase may be either an aqueous phase containing oxidizing salts, or it may be a molten oxidizer salt phase.

DETAILED DESCRIPTION OF THE INVENTION

The energetic emulsions of the present invention include a continuous oil phase, and a discontinuous oxidizer phase. The fuel for the reaction is provided by the continuous oil phase, and the oxygen is provided by the discontinuous oxidizer phase. The term "emulsion" as used in this specification and in the appended claims is intended to cover not only water-in-oil emulsions, but also melt-in-oil emulsions. The water-in-oil emulsions have a discontinuous aqueous phase containing oxidizing salts suspended in a continuous oil phase. The melt-in-oil emulsions have a discontinuous oxidizer phase containing oxidizing salts which have a melting point low enough that they may be conveniently emulsified into the continuous oil phase. The oxidizing salts may contain some water of hydration and accordingly, an emulsion prepared without addition of water to form the discontinuous phase may actually contain some water. However, the presence of water in a melt-in-oil emulsion is not required and the discontinuous phase often comprises a low melting mixture of oxidizing salts. Although, there is not a sharp line between water-in-oil and melt-in-oil emulsion, the term water-in-oil is used when the salts are dissolved in additional water to form the discontinuous phase and the term melt-in-oil is used when the oxidizing salts are liquefied without the addition of water, to form the discontinuous phase.

The energetic emulsions of the present invention are formed by mixing the discontinuous phase, under emulsifying conditions, with the oil phase. A proper emulsifying agent is selected which allows either the molten salt composition, or the aqueous solution of salt to be dispersed within the continuous oil phase. The compositions have a thickening agent which consists of a polymer containing a carboxyl group, and either thiourea or a sodium thiocyanate or mixture thereof used as a promoter. Finally, the compositions may include sensitizers which may include gassing agents to create bubbles within the compositions. If nitrites are used as the gassing agent, the thiourea or sodium thiocyanate may also function as part of the gas generation system.

The term "hydrocarbyl" is used herein to include:

(1) hydrocarbyl groups, that is, aliphatic (e.g., alkyl or alkenyl), alicyclic (e.g., cycloalkyl, cycloalkenyl), aromatic, aliphatic- and alicyclic-substituted aromatic groups and the like as well as cyclic groups wherein the ring is completed through another portion of the molecule (that is, any two indicated groups may together form an alicyclic group);

(2) substituted hydrocarbyl groups, that is, those groups containing non-hydrocarbon groups which, in the context of this invention, do not alter the predominantly hydrocarbyl nature of the hydrocarbyl group; those skilled in the art will be aware of such groups, examples of which include ether, oxo, halo (e.g., chloro and fluoro), alkoxyl, mercapto, alkylmercapto, nitro, nitroso, sulfoxy, etc.;

(3) hetero groups, that is, groups which, while having predominantly hydrocarbyl character within the context of this invention, contain other than carbon in a ring or chain otherwise composed of carbon atoms. Suitable heteroatoms will be apparent to those of skill in the art and include, for example, sulfur, oxygen, nitrogen and such substituents as pyridyl, furanyl, thiophenyl, imidazolyl, etc.

In general, no more than about three nonhydrocarbon groups or heteroatoms and preferably no more than one, will be present for each ten carbon atoms in a hydrocarbyl group. Typically, there will be no such groups or heteroatoms in a hydrocarbyl group and it will, therefore, be purely hydrocarbon.

The hydrocarbyl groups are preferably free from acetylenic unsaturation. Ethylenic unsaturation, when present will generally be such that there is no more than one ethylenic linkage present for every ten carbon- to-carbon bonds. The hydrocarbyl groups are often completely saturated and therefore contain no ethylenic unsaturation.

The term "lower" as used herein in conjunction with terms such as alkyl, alkenyl, alkoxy, and the like, is intended to describe such groups which contain a total of up to 7 carbon atoms.

(A) DISCONTINUOUS PHASE

The energetic emulsions of the present invention have the oxidizing portion of the composition in the discontinuous phase. The discontinuous phase may be either an aqueous phase comprising oxygen-supplying components dissolved in water. The amount of water in the discontinuous phase is selected so as to provide a highly concentrated solution of oxidizing salts which may be dispersed by emulsification into the continuous oil phase. The methods of forming emulsion explosives have been the subject of numerous patents, and are well known to those skilled in the art. It is desirable that the solution of the inorganic oxidizer salt remain as a super cooled liquid after the formation and cooling of the emulsion, since crystallization of the oxidizer salts tends to break the emulsion and make the explosive less sensitive to detonation.

The oxygen-supplying component is preferably at least one inorganic oxidizer salt such as ammonium, alkali or alkaline earth metal nitrate, chlorate or perchlorate. Examples include ammonium nitrate, sodium nitrate, potassium nitrate, magnesium nitrate, calcium nitrate, ammonium chlorate, sodium perchlorate, magnesium per chlorate and ammonium perchlorate. Ammonium nitrate is preferred as the main oxidizing salt. Other nitrates, chlorates or perchlorates such as those of strontium, barium, copper, zinc, manganese and lead may be used. Mixtures of ammonium nitrate and sodium or calcium nitrate are commonly used. In one embodiment inorganic oxidizer salt comprises principally ammonium nitrate, although up to about 25% by weight of the oxidizer phase can comprise either another inorganic nitrate (e.g., alkali or alkaline earth metal nitrate) or an inorganic perchlorate, for example, ammonium perchlorate or an alkali or alkaline earth metal perchlorate or a mixture thereof.

In another embodiment, the composition is a melt-in-fuel emulsion. In such emulsions, the discontinuous oxidizer phase comprises a mixture of oxidizing salts may be melted and used to form an emulsion much like that formed using aqueous solutions of the oxidizing salts. The oxidizer melt may include nonaqueous materials which decrease the melting point of the oxidizing salt mixture. Various eutectic combinations of oxidizing salts may be used. In addition to the salts, other ingredients may be added to the oxidizer melt such as the perchlorate adducts of amines, urea nitrate, urea perchlorate, nitroguanidine, guanidine nitrate and guanidine perchlorate. Occasionally polyols such as ethylene glycol and glycerol may be added to the molten inorganic oxidizer salts. When glycols are used, in addition to lowering the melting point of the salts, they become part of the fuel for the explosive reaction. Melt-in-fuel emulsion explosives are the subject of numerous patents, and the method of forming suitable melts of oxidizer salts, as well as forming emulsions of such melts in a continuous oil phase are well known to those skilled in the art.

(B) OIL PHASE

The continuous organic phase is preferably present at a level of at least about 2% by weight, more preferably in the range of from about 2% to about 15% by weight, more preferably in the range of from about 3.5% to about 8% by weight based on the total weight of explosive emulsion.

The carbonaceous fuel that is useful in the explosive emulsions of the invention can include most hydrocarbons, for example, paraffinic, olefinic, naphthenic, aromatic, saturated or unsaturated hydrocarbons, and is typically in the form of an oil or a wax or a mixture thereof. In general, the carbonaceous fuel is a water-immiscible, emulsifiable hydrocarbon that is either liquid or liquefiable at a temperature of up to about 95° C., and preferably between about 40° C. and about 75° C. Oils from a variety of sources, including natural and synthetic oils and mixtures thereof can be used as the carbonaceous fuel.

Natural oils include animal oils and vegetable oils (e.g., castor oil, lard oil) as well as solvent-refined or acid-refined mineral oils of the paraffinic, naphthenic, or mixed paraffin-naphthenic types. Oils derived from coal or shale are also useful. Synthetic oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); alkyl benzenes (e.g., dodecylbenzenes, tetradecylbenzenes, dinonylbenzenes, di-(2-ethylhexyl) benzenes, etc.); polyphenyls (e.g., biphenyls, terphenyls, alkylated polyphenyls, etc.); and the like.

Another suitable class of synthetic oils that can be used comprises the esters of dicarboxylic acids (e.g., phthalic acid, succinic acid, alkyl succinic acid, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, pentaerythritol, etc.). Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethyl-hexanoic acid, and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another class of useful oils. These include tetraethyl-silicate, tetraisopropylsilicate, tetra-(2-ethylhexyl)-silicate, tetra-(4-methyl-hexyl)-silicate, tetra(p-tert-butylphenyl)-silicate, hexyl (4-methyl-2-pentoxy)-disiloxane, poly(methyl)-siloxanes, poly-(methylphenyl)-siloxanes, etc. Other useful synthetic oils include liquid esters of phosphorus-containing acid (e.g., tricresyl phosphate, trioctyl phosphate, diethyl ester of decane phosphonic acid, etc.), polymeric tetrahydrofurans, and the like.

Unrefined, refined and rerefined oils (and mixtures of each with each other) of the type disclosed hereinabove can be used. Unrefined oils are those obtained directly from a natural or synthetic source without further purification treatment. For example, a shale oil obtained directly from a retorting operation, a petroleum oil obtained directly from distillation or ester oil obtained directly from an esterification process and used without further treatment would be an unrefined oil. Refined oils are similar to the unrefined oils except that they have been further treated in one or more purification steps to improve one or more properties. Many such purification techniques are known to those of skill in the art such as solvent extraction, distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed toward removal of spent additives and oil breakdown products.

Examples of useful oils include a white mineral oil available from Witco Chemical Company under the trade designation KAYDOL; a white mineral oil available from Shell under the trade designation ONDINA; and a mineral oil available from Pennzoil under the trade designation N-750-HT. Diesel fuel (e.g., Grade No. 2-D as specified in ASTM D-975) can be used as the oil.

The carbonaceous fuel can be any wax having melting point of at least about 25° C., such as petrolatum wax, microcrystalline wax, and paraffin wax, mineral waxes such as ozocerite and montan wax, animal waxes such as spermacetic wax, and insect waxes such as beeswax and Chinese wax. Useful waxes include waxes identified by the trade designation MOBILWAX 57 which is available from Mobil Oil Corporation; D02764 which is a blended wax available from Astor Chemical Ltd.; and VYBAR which is available from Petrolite Corporation. Preferred waxes are blends of microcrystalline waxes and paraffin.

In one embodiment, the carbonaceous fuel includes a combination of a wax and an oil. In this embodiment, the wax content is at least about 25% and preferably ranges from about 25% to about 90% by weight of the organic phase, and the oil content is at least about 10% and preferably ranges from about 10% to about 75% by weight of the organic phase. These mixtures are particularly suitable for use in cap-sensitive explosive emulsions.

(C) EMULSIFIER

A wide variety of emulsifiers have been used in producing emulsions with an aqueous oxidizer phase, as well as the melt-in-oil emulsions with a nonaqueous oxidizer phase. Among the emulsifiers which have been used are amines such as oleylamine, cocoamine, stearylamine, dodecylamine, and hexylamine. Amine salts such as oleylamine acetate, oleyl-n-propylamine acetate, dodecylamine acetate, octadecylamine acetate, oleylamine linoleate and soyaamine lineoleate has been used. Other amine type surfactants which have proven to be useful are the oleyloxazoline derivatives. Anionic surfactants such as sodium oleate, sodium lauryl sulfate, sodium dodecylbenzene sulfonate, sodium dimethylnaphthalene sulfonate, stearic acid, linoleic acid, polyethoxylated fatty acids, alkyl-aryl sulfonic acids, sodium dioctyl sulfosuccinate and potassium olefin sulfonates have been used as surfactants. Nonionic surfactants such as sorbitan monooleate, sorbitan monopalmitate, sorbitan sesquioleate, lecithin and alkyl phenoxypolyethoxyethanols are commonly used. Amphoteric surfactants such n-coco-3-aminobutyanoic acid and the dodecylamine salt of dodecylbenzene sulfonic acid may also be used as surfactants.

Another group of emulsifiers useful in the present invention are emulsifiers which are derived from hydrocarbyl substituted succinic acylating agents. Succinic acid derivative emulsifiers prepared from succinic acylating agents are disclosed in U.S. Pat. Nos. 5,047,175; and 4,828,633, 4,919,178, 4,919,179, 4,844,756, 4,818,309, 4,708,753, and European Patent application EP 561,600. U.S. Pat. Nos. 5,512,079 and 5,518,517 disclose emulsion fertilizers. The emulsifiers prepared from succinic acylating agents disclosed in these patents are useful in the present invention.

The succinic acylating agents useful in preparing emulsifiers include hydrocarbyl-substituted succinic acids and anhydrides which may be represented by the formulae:

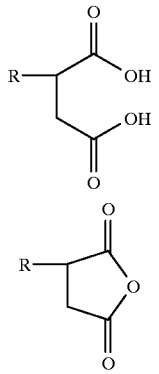

wherein R is a $C_{10}$ to about a $C_{500}$ hydrocarbyl group. Preferably, R is an aliphatic or alicyclic hydrocarbyl group with less than about 10% of its carbon-to-carbon bonds being unsaturated. R may derived from olefin polymers. R may also be derived from non-polymerized olefins of from 10 to about 18 carbon atoms with alpha-olefins being particularly useful.

The polymeric materials which may be used to prepare the succinic acylating agents may be characterized, as above, by the average number of carbon atoms which they contain. Polymeric materials are not uniform, and contain a variety of molecules of different chain lengths. Such polymers have been characterized by their Mn (number average molecular weight). The average number of carbons correlates with the Mn of the polymer. For example, if a polymer containing an average of 100 carbon atoms is reacted with maleic anhydride, the substituted succinic anhydride produced has an Mn of approximately 1500. Similarly, for a polymer containing an average of 500 carbon atoms, the substituted succinic anhydride produced would have an Mn of approximately 7100. Such polymers have also been characterized by their Mw (weight average molecular weight). Because the chain lengths of a polymeric material are not always evenly distributed, the Mw and Mn are not always identical. The polymeric materials useful in preparing the hydrocarbyl substituted succinic acylating agents have Mw/Mn ratios from about 1.5 to about 4.5. Materials with ratios of about 1.5 to about 3.6 or 3.2 are useful. Materials with ratios of about 1.8, or about 2, to about 2.5, about 3.2, or about 3.6 are useful. Gel permeation chromatography may be used to determine the values of Mw and Mn as well as the Mw/Mn ratio. A useful method is disclosed in U.S. Pat. No. 4,234,435.

If an excess of maleic anhydride is reacted with the polymeric material to form the substituted succinic acylating agent, more than one succinic group may add to an individual polymer chain. The amount of such poly-substitution may be expressed in terms of the number of succinic groups for each equivalent weight of substituent group (derived from the polymeric material).

The equivalent weight of the polyalkene is its Mn. The equivalents of substituent groups in the succinic acylating agent is determined by dividing the total weight of substituents by the Mn of the polyalkene. The number of succinic groups per equivalent weight of substituents present in the succinic acylating agent may be found by comparing the equivalents of succinic groups in the molecule to the equivalents of substituents. This subject is disclosed in U.S. Pat. No. 4,234,435 which is hereby incorporated by reference for its disclosure of methods determining the number of succinic groups per equivalent of substituents and for its disclosure of methods of measuring the values of Mw and Mn.

In general, the derivatives of the succinic acylating agents which are useful as emulsifiers in the present invention are prepared by reacting the succinic acylating agent with co-reactants capable of reacting with a carboxyl or an anhydride group such as ammonia, amines, alcohols, alkanol amines, and phenols. As those skilled in the art will readily appreciate, the wide variety of amines, alkanol amines, phenols and alcohols available, leads to are great variety of possible emulsifiers useful in the present invention. In addition, as will be set forth below, the initial products may be treated with other reagents to form derivatives.

Amine co-reactants include aliphatic amines, aromatic amines, heterocyclic amines, monoamines, diamines, polyamines, primary, secondary, and tertiary amines. The classes of amines are not exclusive. For example a polyamine may include both primary, secondary or tertiary nitrogens. The class of alcohol co-reactants includes aliphatic alcohols and aromatic alcohols (phenols). The class includes monoalcohols, glycols (dialcohols) and polyalcohols. The alcohols include compounds which are formed by reacting a conventional alcohol with an epoxide to form an alcohol containing ether linkages. Amino alcohols may also be reacted with succinic acylating agents to form emulsifiers of the present invention. The amino alcohols contain both an amino group and an alcohol group. Amino alcohols are able to undergo the reactions of both amines and alcohols.

(D) SENSITIZERS FOR USE WITH EMULSION EXPLOSIVES

When the energetic emulsions of the present invention are used as emulsions exclusively, it is often desirable to add synthesizers to the emulsion. These sensitizers help to assure that the emulsion works as an explosive. In one embodiment of the invention, closed-cell, void-containing materials are used as sensitizing components. The term "closed-cell, void-containing material" is used herein to mean any particulate material which comprises closed cell, hollow cavities. Each particle of the material can contain one or more closed cells, and the cells can contain a gas, such as air, or can be evacuated or partially evacuated. In one embodiment of the invention, sufficient closed cell void containing material is used to yield a density in the resulting emulsion of from about 0.8 to about 1.35 g/cc, more preferably about 0.9 to about 1.3 g/cc, more preferably about 1.1 to about 1.3 g/cc. In general, the emulsions of the subject invention can contain up to about 15% by weight, preferably from about 0.25% to about 15% by weight of the closed cell void containing material. Preferred closed cell void containing materials are discrete glass spheres having a particle size within the range of about 10 to about 175 microns. In general, the bulk density of such particles can be within the range of about 0.1 to about 0.4 g/cc. Useful glass microbubbles or microballoons which can be used are the microbubbles sold by 3M Company and which have a particle size distribution in the range of from about 10 to about 160 microns and a nominal size in the range of about 60 to 70 microns, and densities in the range of from about 0.1 to about 0.4 g/cc.; these include microballoons distributed under the trade designation C15/250. Other useful glass microbubbles are sold under the trade designation of ECCOSPHERES by Emerson & Cumming, Inc., and generally have a particle size range from about 44 to about 175 microns and a bulk density of about 0.15 to about 0.4 g/cc. Other suitable microbubbles include the inorganic microspheres sold under the trade designation of Q-CEL by Philadelphia Quartz Company. The closed cell void containing material can be made of inert or oxidizable materials. For example, phenol-formaldehyde microbubbles can be utilized within the scope of this invention. If the phenol-formaldehyde microbubbles are utilized, the microbubbles themselves are a fuel component for the explosive and their fuel value should be taken into consideration when designing a water-in-oil emulsion explosive composition. Another closed cell void containing material which can be used within the scope of the subject invention is the saran microspheres sold by Dow Chemical Company. The saran microspheres have a diameter of about 30 microns and a particle density of about 0.032 g/cc. Because of the low bulk density of the saran microspheres, it is preferred that only from about 0.25 to about 1% by weight thereof be used in the water-in-oil emulsions of the subject invention.

Other suitable sensitizing components which may be employed alone or in addition to the foregoing include insoluble particulate solid self-explosives such as, for example, grained or flaked TNT, DNT, RDX and the like and water-soluble and/or hydrocarbon-soluble organic sensitizers such as, for example, amine nitrates, alkanolamine nitrates, hydroxyalkyl nitrates, and the like. The explosive emulsions of the present invention may be formulated for a wide range of applications. Any combination of sensitizing components may be selected in order to provide an explosive composition of virtually any desired density, weight-strength or critical diameter. The quantity of solid self-explosive ingredients and of water-soluble and/or hydrocarbon-soluble organic sensitizers may comprise up to about 40% by weight of the total explosive composition. Gas bubbles which are generated in-situ by adding to the composition and distributing therein a gas-generating material such as inorganic peroxides such as sodium peroxide potassium and barium peroxide, alkali metal and alkaline earth metal carbonates, alkali metal nitrites, and organic gassers such as $N,N^1$-dinitrosopentamethylenetetramine. An aqueous solution of sodium nitrite, may be used to generate gas bubbles in an explosive emulsion composition. The volume of the occluded gas component may comprise up to about 50% of the volume of the total explosive composition.

(E) PROPELLENT COMPOSITIONS

When the energetic emulsions of the present invention are used as rocket propellants, it is important to slow the rate of reaction so as to produce controlled combustion. Inadvertent inclusion of gas within the emulsion should be avoided since gas bubbles serve as sensitizers. The rate of reaction may be slow through the use of well-known additives, or through the use of particulate fuels which burn more slowly than the oil used to create the emulsion. Sawdust, wood chips, nut shells, are good examples of such particulate fuels.

(F) THICKENER SYSTEM

The thickener system comprises a carboxyl-containing polymer and a promoter such as thiourea or sodium thiocyanate. The carboxyl-containing polymer for use in the present invention have a polymer backbone and pendant carboxyl groups. The carboxyl may be in the form of a carboxylic acid. However, it is preferred that the carboxyl groups be in the form of an anhydride or a low molecular weight ester. Methyl and ethyl esters are particularly preferred as esters. The polymer backbone may be ethylenic such as that in styrene/maleic anhydride copolymers. Other polymeric backbones such as polyester backbones may also be used. Such a polymer could be formed by reacting a polycarboxylic acid with more than two carboxyl groups with a limited amount of a diol so as to form a polymer having pendant unreacted carboxylate groups. The polymer backbone could also be a polyether-type material. The nature of the polymer backbone is not important in the compositions of the present invention. The important feature of the polymer is that it have carboxylate groups independent from the polymer chain and that these carboxylate groups are free to react. Accordingly, any polymer backbone which has independent carboxylic acid groups, lower molecular weight ester groups, or anhydride groups may be used as the polymer in the present invention. The polymer may be represented by the following generalized structures:

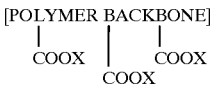

where X is H, Methyl or Ethyl

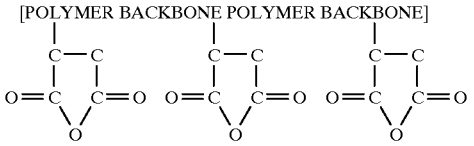

-continued

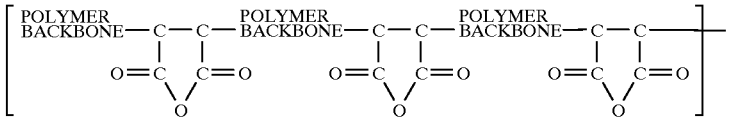

The polymer has a molecular weight such that it is oil soluble and thus, it is generally found in the continuous phase of the emulsion. Generally, the polymer has a molecular weight (number average) of between about 2000 and about 50,000. The emulsion may be formed normally and subsequently, the polymer may be added to and stirred into a completed emulsion. Alternatively, the polymer may be dissolved in the oil prior to the formation of the emulsion. Once the polymer is incorporated into the emulsion, thiourea or sodium thiocyanate may be added as a promoter. Surprisingly it has been found that the thiourea or sodium thiocyanate act as promoters and cause a rapid thickening of the emulsion to form a rubbery solid which no longer flows. Although the polymeric material wouldn't be expected to be in the oil phase, and the thiourea and sodium thiocyanate are in the discontinuous phase of the emulsion, an interaction takes place between the two which causes rapid thickening of the emulsion. Although the nature of this interaction is not clear, the effect is reproducible, and the thickening which it produces is very useful.

The energetic emulsions of the present invention are useful for situations in which it is desirable to prepackage the emulsion explosive in precast form. The precast form may be in various shapes or various purposes. However, commonly precast emulsion explosives are packages in cylindrical tubes. For example, the package size may vary from approximately 25 mm to approximately 150 mm in diameter. They may be used for surface application such as excavation, pipe laying and road construction. They may also be used in mining applications such as copper, gold, iron and coal mining. In addition, the rapid thickening of the emulsion may be used in loading what are called upholes in a rock face. Upholes are holes which are bored vertically, and it is extremely useful to have an explosive composition which may be forced into the hole and which rapidly thickens so that it does not run out. The energetic emulsions of the present invention are also useful as rocket propellants.

In one embodiment, the emulsion is sensitized by using sodium nitrite to form gas bubbles within the emulsion. In order to use sodium nitrite as a gassing agent, the liquid phase must contain some water which may be made acid, that is, approximately pH 2 to 5 in order to facilitate the decomposition of sodium nitrite to form gas bubbles. This may be accomplished through the use of salts which give an acid solution, such as zinc nitrate or acids such as the mineral acids or the stronger organic acids such as acetic acid or sulfonic acids. In this method of gassing, an emulsion of the correct pH range, including the polymer, is mixed with sodium nitrite. Sodium thiocyanate or thiourea or mixtures thereof are added along with the sodium nitrite to act as accelerators of the gassing reaction. Surprisingly, not only do they act in their known capacity as accelerators, they serve to thicken the emulsion.

EXAMPLE 1

Emulsion No Gassing

An emulsion polymer was prepared from two separate phases. The phases comprise

| Component | Weight Percent |
|---|---|
| Aqueous Phase | |
| $NH_4NO_3$ | 81.25 |
| $Zn(NO_3)_2$ | 0.25 |
| $H_2O$ | 18.5 |
| Oil Phase | |
| Sorbitan Monoleate | 7.41 |
| LZ 2825 | 29.63 |
| Diesel Fuel | 62.96 |

LZ 2825 is a 2,000 molecular weight polyisobutylene succinic anhydride reacted with dimethyl ethanol amine (1:1 eq) with the removal of water.

To 94.6 parts of the aqueous phase was added to 5.4 parts of the oil phase and the two phases were slowly mixed. To 100 parts by weight of the emulsion, one part of a maleic anhydride ethylene/α-olefin copolymer (MOLECULAR WEIGHT?) as a 50% solution in dioctyl adipate is added. After the polymer is stirred into the emulsion, the viscosity of the finished emulsion was 59,185 cP.

EXAMPLE 2

Polymer With $NaNO_2$ Gassing

An emulsion was prepared from two separate phases. The aqueous phase comprises

| Component | Weight Percent |
|---|---|
| Aqueous Phase | |
| $NH_4NO_3$ | 81.25 |
| $Zn(NO_3)_2$ | 0.25 |
| $H_2O$ | 18.5 |
| Oil Phase | |
| Sorbitan Monoleate | 7.41 |
| LZ 2825 | 29.63 |
| Diesel Fuel | 62.96 |

LZ 2825 is a 2,000 molecular weight polyisobutylene succinic anhydride reacted with dimethyl ethanol amine (1:1 eq) with the removal of water.

To 94.6 part of the aqueous phase was added to 5.4 parts of the oil phase and the two phases are slowly mixed. To 100 parts by weight of the emulsion, one part of a maleic anhydride ethylene/α-olefin copolymer (MOLECULAR WEIGHT?) as a 50% solution in dioctyl adipate was added. After the polymer is stirred into the emulsion, the viscosity of the finished emulsion was 59,185 cP. In addition, 0.6 parts per weight of a 15% $NaNO_2$ solution was added as a gassing agent. The viscosity of the emulsion after gassing is 91,235 cP.

EXAMPLE 3

No Polymer With $NaNO_2$/NaSCN Gassing

An emulsion was prepared from two separate phases. The aqueous phase comprises

| Components | Weight Percent |
|---|---|
| Aqueous Phase | |
| $NH_4NO_3$ | 81.25 |
| $Zn(NO_3)_2$ | 0.25 |
| $H_2O$ | 18.5 |
| Oil Phase | |
| Sorbitan Monoleate | 7.41 |
| LZ 2825 | 29.63 |
| Diesel Fuel | 62.96 |

LZ 2825 is a 2,000 molecular weight polyisobutylene succinic anhydride reacted with dimethyl ethanol amine (1:1 eq) with the removal of water.

To 94.6 part of the aqueous phase was added to 5.4 parts of the oil phase and the two phases were slowly mixed. To 0.6 parts of a solution of $NaNO_2$/NaSCN (15%/30% in water) was added as a gassing agent. The viscosity of the emulsion after gassing was 141,667 cP.

EXAMPLE 4

Polymer With $NaNO_2$/NaSCN Gassing an emulsion was prepared from two separate phases. The aqueous phase comprises

| Components | Weight Percent |
|---|---|
| Aqueous Phase | |
| $NH_4NO_3$ | 81.25 |
| $Zn(NO_3)_2$ | 0.25 |
| $H_2O$ | 18.5 |
| Oil Phase | |
| Sorbitan Monoleate | 7.41 |
| LZ 2825 | 29.63 |
| Diesel Fuel | 62.96 |

LZ 2825 is a 2,000 molecular weight polyisobutylene succinic anhydride reacted with dimethyl ethanol amine (1:1 eq) with the removal of water.

To 94.6 part of the aqueous phase was added to 5.4 parts of the oil phase and the two phases were slowly mixed. To 100 parts by weight of the emulsion, one part of a maleic anhydride ethylene/α-olefin copolymer (MOLECULAR WEIGHT?) as a 50% solution in dioctyl adipate is added. After the polymer is stirred into the emulsion, the viscosity of the finished emulsion is 59,185 cP. In addition, 0.6 parts of a solution of $NaNO_2$/NaSCN (15%/30% in water) was added as a gassing agent. The viscosity of the emulsion after gassing was 218,432 cP.

The ratios of emulsion:polymer:gassing solution was 100:0.5:06 where the 0.5 refers to the 50% diluted polymer. The ratio would be 0.25 if referring to the neat polymer.

We claim:

1. An energetic emulsion explosive composition comprising a discontinuous oxidizer phase, a continuous oil fuel phase, an emulsifier and a thickener composition comprising a carboxyl containing polymer and a promoter selected from the group consisting of sodium thiocyanate and thiourea; wherein the carboxyl containing polymer comprises a polymer backbone and pendant carboxyl groups; wherein the polymer backbone is selected from the group consisting of ethylenic backbones, polyester backbones, and mixtures thereof.

2. A composition according to claim 1 where the promoter is sodium thiocyanate.

3. A composition according to claim 1 where the promoter is thiourea.

4. A composition according to claim 1 where the oxidizer phase is an aqueous phase.

5. A composition according to claim 4, where the promoter is sodium thiocyanate.

6. A composition according to claim 4, where the promoter is thiourea.

7. A composition according to claim 1, where the oxidizer phase is a melt phase.

8. A composition according to claim 7 where the promoter is sodium thiocyanate.

9. A composition according to claim 7 where the promoter is thiourea.

10. A composition according to claim 7, where the polymer backbone is an ethylenic backbone.

11. A composition according to claim 7, where the polymer backbone is a polyester backbone.

12. A thickened emulsion rocket propellant composition comprising a discontinuous oxidizer phase, a continuous oil fuel phase, an emulsifier and a thickener composition comprising a carboxyl containing polymer and a promoter selected from the group consisting of sodium thiocyanate and thiourea; wherein the carboxyl containing polymer comprises a polymer backbone and pendant carboxyl groups; wherein the polymer backbone is selected from the group consisting of ethylenic backbones, polyester backbones, and mixtures thereof.

13. A composition according to claim 12 where the promoter is sodium thiocyanate.

14. A composition according to claim 12 where the promoter is thiourea.

15. A composition according to claim 12 where the oxidizer phase is an aqueous phase.

16. A composition according to claim 12 where the oxidizer phase is an aqueous phase.

17. A composition according to claim 12 where the oxidizer phase is a melt phase.

* * * * *